United States Patent [19]

Partlow

[11] 3,952,467

[45] Apr. 27, 1976

[54] EXTENDIBLE TOWER STRUCTURE

[75] Inventor: Jackson A. Partlow, Rock Hill, S.C.

[73] Assignee: Zip-Up Lighting Tower Company, Inc., Spartanburg, S.C.

[22] Filed: Nov. 15, 1974

[21] Appl. No.: 524,064

Related U.S. Application Data

[63] Continuation of Ser. No. 121,443, March 5, 1971, abandoned.

[52] U.S. Cl. ..... 52/121; 212/55

[51] Int. Cl.[2] ..... B66C 23/06; E04H 12/34

[58] Field of Search ..... 52/28, 118–121; 308/6 R; 212/55; 16/105

[56] References Cited

UNITED STATES PATENTS

| | | | |
|---|---|---|---|
| 1,090,306 | 3/1914 | Hoffman | 16/105 |
| 1,426,276 | 8/1922 | Christie | 52/28 |
| 2,576,389 | 11/1951 | Craighead et al. | 52/121 |
| 2,621,863 | 12/1952 | Nagel | 52/121 |
| 3,029,954 | 4/1962 | Grant | 212/55 |
| 3,328,921 | 7/1967 | Keslin | 52/121 |
| 3,622,211 | 11/1971 | Mitton | 308/6 R |
| 3,638,806 | 2/1972 | Hippach | 52/121 |
| 3,817,007 | 6/1974 | Hall | 52/121 |

FOREIGN PATENTS OR APPLICATIONS

| | | | |
|---|---|---|---|
| 43,819 | 7/1938 | Netherlands | 52/121 |

*Primary Examiner*—J. Karl Bell
*Attorney, Agent, or Firm*—Wellington M. Manning, Jr.

[57] ABSTRACT

An extendible tower is disclosed herein having a base section and a plurality of nestable extendible sections associated therewith. A single cable drive system is concealed within the sections and is employed to raise and lower the extendible sections with respect to each other. Adjustable roller guides are provided for each extendible section so as to insure proper raising and lowering thereof. The uppermost section may be provided with any desired apparatus or equipment such as lights, a work platform, or the like. The tower may be portable and self-sufficient. When mounted on a trailer or other vehicle having electrical generator means thereon, the tower may be transported to any desired location and generate its own power for raising and lowering of the tower, for operation of lights, and the like. Such a tower may likewise be equipped with reel means for maintaining appropriate tension on electrical or other service lines that extend through the tower sections to lights or other apparatus mounted on top of the tower.

11 Claims, 8 Drawing Figures

INVENTOR.
JACKSON A. PARTLOW
BY
Wellington M. Manning, Jr.
ATTORNEY

INVENTOR.
JACKSON A. PARTLOW
BY
Wellington M. Manning, Jr.
ATTORNEY

INVENTOR.
JACKSON A. PARTLOW
BY
Wellington M. Manning, Jr.
ATTORNEY

EXTENDIBLE TOWER STRUCTURE

CROSS REFERENCE TO RELATED APPLICATION

This is a continuation of application Ser. No. 121,443, filed Mar. 5, 1971, now abandoned.

BACKGROUND OF THE INVENTION

The present invention relates to a collapsible tower that may be portable or may be permanently secured on location. Portability of such a tower is feasible only if the tower is capable of assuming a collapsed state during transportation. Likewise, for both the portable tower and the stationary tower, collapsibility of the tower greatly enhances the advantages of the tower due to ease of performing preventive maintenance and repair to the tower as well as replacement of items such as light bulbs used with apparatus secured to the top of the tower. Extendible or collapsible towers are presently existent and generally are mounted on a trailer, truck, platform or the like. Further, present extendible towers are generally employed to support banks of lights for illuminating construction sites, carnivals, fairgrounds and the like; to support signs for advertising, to support platforms that provide a work surface, or the like.

Heretofore, extendible towers have generally been constructed from welded sections and raised and lowered by various arrangements of a plurality of cables or the like. These towers are cumbersome, very expensive and represent definite safety hazards. The sections for example, have generally been fabricated from a plurality of structural members welded together to form a skeletal structure. Skeletal structures when extended, offer less resistance to the wind than a solid structure of the same size, but are much more expensive to fabricate. Prior towers further have assumed various geometrical shapes such as triangles, circles, rectangles, etc. and, for the most part, the geometric shapes have provided edges around which guides were employed to maintain alignment between the sections. Raising and lowering of the prior art towers has normally been accomplished by a plurality of cables either interconnected between the sections as a continuous cable or as separate cables connecting each section to the next adjacent section. Single cable systems have also been employed, but have not heretofore proved satisfactory.

All of the presently existing towers have been found to be deficient in certain respects. For example, structures used in the prior towers have dictated excessive expense in fabrication of the sections; set up and maintenance of the cable system; in the size and strength of the platform, trailer or the like required for transporting the tower, etc. Hence economics precludes feasible use of existing towers for numerous situations. Further, presently existing towers may present safety hazards during raising, lowering and while standing in the raised position. Continued application of force to the cable system after the tower has been completely raised can cause the tower to buckle and fall. Likewise, during raising and lowering, the present existing towers are dangerous.

The tower of the present invention overcomes all the problems and disadvantages of the prior towers. Specifically, the instant tower is economical to manufacture, maintenancefree, safe, efficient and easy to operate and transport. Moreover, the instant tower represents a tremendous aesthetic improvement over existing towers.

The prior art contains numerous teachings of extendible towers as exemplified by U.S. Pat. Nos. 2,576,389 to Craighead et al; 2,787,343 to Mitchell; 2,822,067 to Price; 2,948,363 to Hopfeld; 2,966,956 to Campbell et al; 3,000,473 to Reynolds; 3,009,546 to Anderson, Sr., et al; 3,266,051 to Attwood; 3,328,921 to Keslin; 3,373,473 to Keslin; 3,439,467 to Partlow, and 3,495,364 to De Bella. None of the prior art, however, either alone or in combination appears to anticipate or suggest the present invention.

SUMMARY OF THE INVENTION

It is an object of the present invention to provide an improved extendible tower.

Another object of the present invention is to provide an extendible tower having a single cable drive system as a raising and lowering means.

Still further, another object of the present invention is to provide an extendible tower comprising nestable sections of an extruded material.

Another object of the present invention is to provide an improved extendible tower having safety features incorporated therewith.

Generally speaking, the extendible tower of the present invention comprises a base section; a plurality of extendible sections associated with said base section, each extendible section being nestable within a next larger section; external, adjustable guide means positioned adjacent the top of the base and each intermediate extendible section to engage and guide the extendible section nestable therein; and an internal single cable drive system for said tower for raising and lowering said extendible sections with respect to said base section.

More specifically, the tower of the present invention is made up of a base section and a plurality of multisided sections that are nestable within each other in a collapsed state. The use of extruded sections are preferred which adds greatly to the rigidity of the overall structure, lowers the cost of manufacture of the sections and enables the cable system, electrical lines and the like to be completely enclosed within the extendible portion of the tower. Enclosure of the cable system, the electrical lines and any other support or service line adds to the aesthetics of the tower and also precludes the possibility of damage thereto by the elements, during raising and lowering of the tower, during transportation of the tower and the like.

The single cable drive system for the tower of the present invention is likewise a definite advantage over those shown and described in the prior art. During raising and lowering of the sections of the instant tower, there is very little friction produced by the cable since the cable is guided through the sections by rotatable pulleys. Moreover, the pulleys are preferably of nylon or some similar type material that requires no appreciable lubrication. Each extendible section of the tower is provided with rotatable pulleys at the bottom and/or top thereof to receive the cable. Pulleys at the bottom of the sections receive the cable for support of the section while pulleys at the top of the sections are positioned transverse to the bottom pulleys and in line therewith so as to permit a change of direction of the cable from a vertical to a horizontal direction. One of the bottom pulleys in each section is rotatably received within a vertical slot in the section.

A power reel or drum is provided for controlled movement of the cable and is operated by an electric motor or other means depending upon the particular environment in which the tower is used. For example, when lights are mounted atop a portable tower, electric power may be supplied from electric lines or from a gasoline operated generator to operate the cable for raising and lowering of the tower and also for providing electrical power for operation of the lights on top of the tower. Conversely, in an environment where the tower is permanently installed as a light pole or the like, the cable reel may be operated by a hand crank, a hand operated, reversible motor or the like. Hence should maintenance be required to lights on the tower, the tower could be lowered to a convenient level where the maintenance could be performed. Thereafter, the tower can be returned to its normal height and not lowered again until maintenance or repair is next required.

Guide means for the instant tower insure proper movement of the individual tower sections during raising and lowering. Misalignment of one section with respect to the next adjacent section is thus avoided and the tower continually functions in a proper manner. A collar is positioned adjacent the top and extends around each tower section that has a smaller, extendible section nestable therein. Guide mounts are adjustably received around the collar, corresponding with each side of the section and have rotatably received thereon guides for each side of the section. Proper operation of the tower dictates close tolerance in the manufacture of the various tower components and since the sections are preferably extruded and will thus vary slightly in size, the rotatable guides are adjustable along slots in the mounts so as to permit movement of the guides corresponding with variations in section size whereby the guides continually engage each side of the section during movement thereof. Preferably, the rotatable guides are manufactured from nylon or some similar material that requires little or no lubrication.

DESCRIPTION OF THE SPECIFIC EMBODIMENTS

Figure 1:
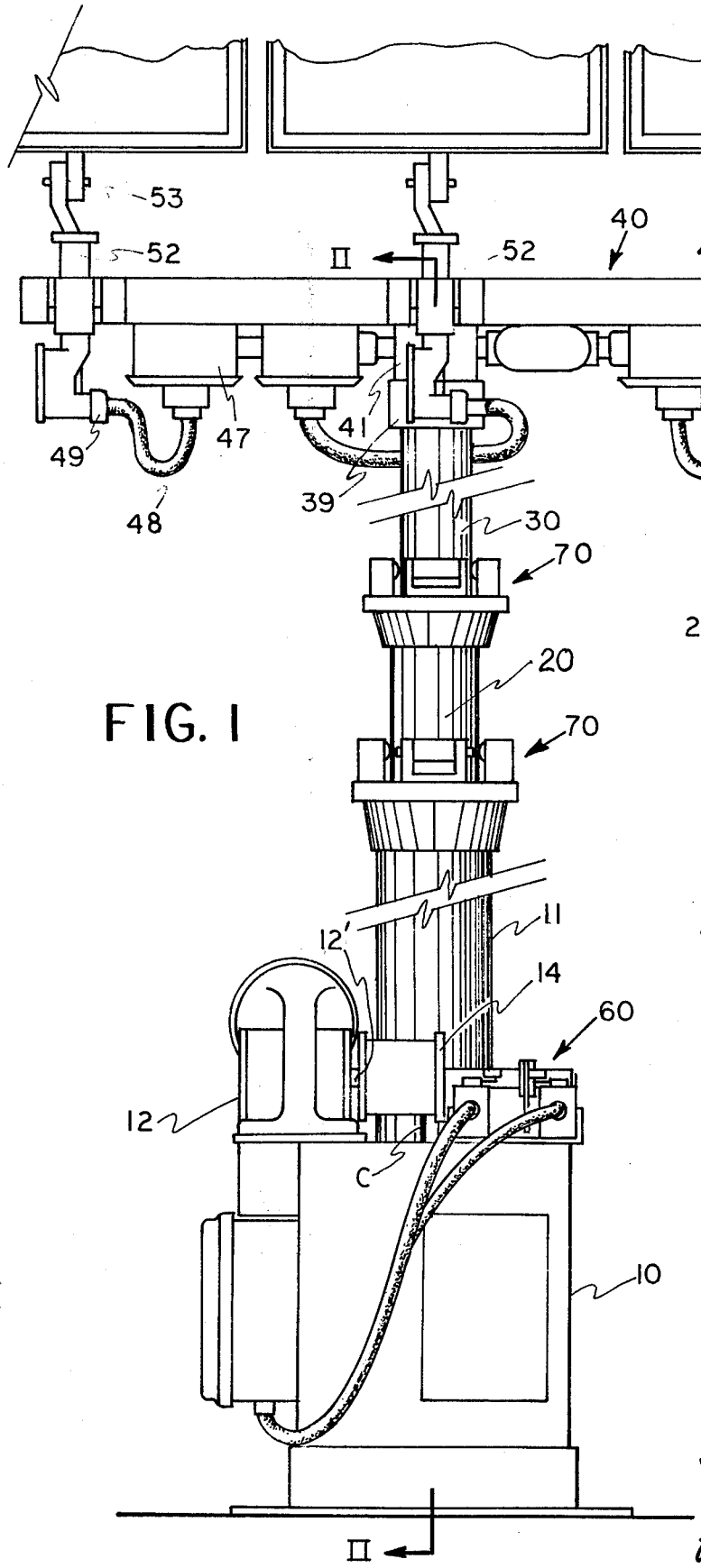
FIG. 1 is a side elevational view of the tower of the present invention in the raised or extended position.

Referring to the Figures, the extendible tower of the present invention will now be described in detail. In FIG. 1, an extended tower is illustrated having a plurality of lights secured to the top thereof. Such a tower might be secured in place for permanent lighting or might be mounted on a truck, a trailer or the like so as to be transportable to any desired temporary location. In the case of mobility, a gasoline operated generator might also accompany the tower on the trailer, etc. so as to produce electricity for raising and lowering of the tower and also for operation of the lights positioned on the tower. Such an arrangement is very useful for temporary lighting needs and also for remote locations where a source of electricity might not be available or if available, not readily accessible.

The tower is thus shown in FIG. 1 to comprise a base 10 with a stationary tower section 11 secured thereto and forming a part of base 10. Base 10 supports the extendible part of the tower and apparatus secured thereto, and depending upon the requirement for the particular tower, may house various components thereof, or may simply serve as a stabilizing support member. A desired number of extendible tower sections are associated with base 10 with each section being nestable within the next adjacent larger section. In FIG. 1 are shown two extendible sections generally indicated as 20 and 30 respectively. Obviously, the number of extendible sections may be varied to provide a desired height telescopingly the tower in the extended position. Likewise, whereas for practical telescopingly any number of sections may be employed with the tower of the present invention, the length of the individual sections may vary.

Extendible section 20 is telescopically receivable by stationary tower section 11 and section 30 is telescopically receivable within section 20. As mentioned earlier, one of the contemplated uses of the instant tower is as a light tower. FIG. 1 thus shows a plurality of lighting fixtures and lights positioned on top of the extended tower. Top tower section 30 thus is adapted to receive a light support structure generally indicated as 40. Support structure 40, as will be defined in more detail hereinafter may rotate completely around section 30 to permit use of lights 50 received thereon at any position around the tower. Further, each light 50 is capable of angular adjustment to direct the lights as desired onto the particular area or object to be illuminated.

A single cable drive system is utilized for raising and lowering the instant tower. The drive system is deployed within the various sections and is thus not shown in FIG. 1. Base 10 is, however, shown to have a motor 12 mounted thereon, said motor being used as a source of operating power for the cable drive system. Motor 12 has a drive shaft 12' extending outwardly therefrom which receives a drum 14 thereon. Drum 14 has a cable C wrapped therearound and serves as a cable supply source. Cable C is the single cable used in the drive system for operation of the tower, and as will be fully described hereinafter is operatively associated with each of the tower sections for raising and lowering the tower.

As with any cable supported tower, safety is an important aspect in the design of the tower. Cable drum 14 accordingly is equipped with a safety system generally indicated as 60 to prevent collapse and/or damage to the tower during the raising and lowering thereof. Further, a guide system generally indicated as 70 is positioned adjacent the top of each tower section that has a further tower section telescopingly receivable therein. Both of these systems will be described in more detail hereinafter.

Figure 2:
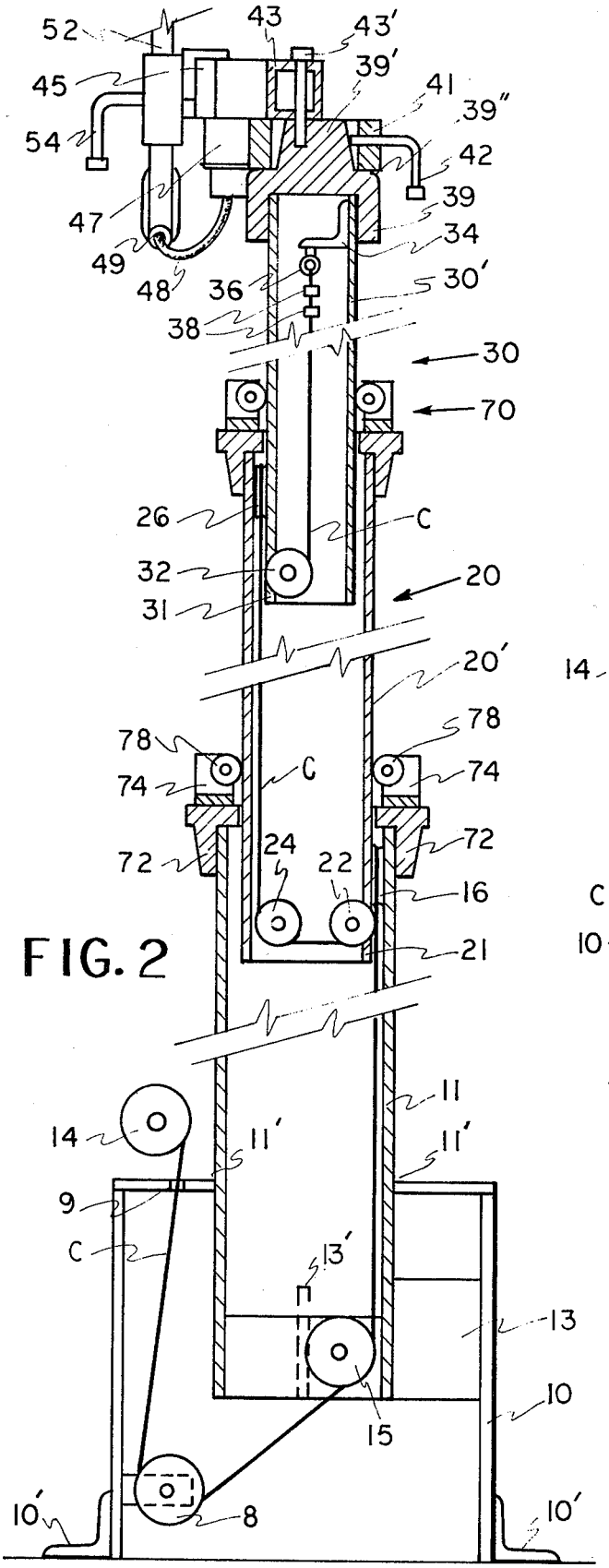
FIG. 2 is a vertical cross section of the tower of the present invention in an extended position and taken along line II—II.

FIG. 2 is a vertical cross section of the extended tower as taken along lines II—II of FIG. 1 and illustrates the operative relationship of internal components of the tower. Base 10 of the instant tower is shown secured to a surface such as a trailer bed by brackets 10'. Stationary tower section 11 is secured to base 10 in any suitable manner as by welding at 11' and held in the proper position by a support 13 positioned under section 11 and having an upward projection 13' telescoping upwardly therein. Stationary section 11 is thus secured against movement and extends upwardly from base 10 to receive a first extendible section 20. Further, section 11 has a rotatable pulley 15 mounted within the lower end thereof and a rotatable pulley 16 mounted within the upper end thereof, said pulleys 15 and 16 being mounted in horizontal planes approximately normal to each other.

First extendible section 20 is comprised of a plurality of side walls 20' and is telescopingly receivable within section 11, being supported by cable C and held in proper alignment by guide means 70 positioned adjacent the top of section 11. Section 20 has two rotatable pulleys 22 and 24 mounted in the lower end thereof, and a single rotatable pulley 26 mounted in the top end thereof, said bottom pulleys 22 and 24 being mounted in a horizontal plane normal to the horizontal plane in which said top pulley 26 is mounted. The lower end of section 20 is further provided with a longitudinal slot 21 in which pulley 22 is positioned and extends partially therethrough. When the tower is in the raised position, pulleys 22 and 24 in the bottom of section 20 are just below pulley 16 of section 11 and are in a horizontal plane normal to the plane in which pulley 16 is mounted.

Second extendible section 30 is comprised of a plurality of side walls 30' and is telescopingly receivable by section 20 and supported by cable C. Section 30, like section 20 is held in proper alignment by a guide means 70. Guide means 70 for section 30 is, however, positioned adjacent the top of section 20. Section 30 has a longitudinal slot 31 in one side 30' in the lower end thereof in which a rotatable pulley 32 is mounted and resides partially therein. A bracket 34 is affixed within the top end of section 30 and has associated therewith an eye bolt 36 and cable clamps 38. Bracket 34 and attendant apparatus are utilized in the top section of the tower. Hence, if section 30 was not the top extendible section of the tower, this apparatus would not be secured therein.

Single cable C is used to raise and lower extendible sections 20 and 30 and to support these sections regardless of their particular positions. Cable C thus is secured at one end to cable reel 14 and is wrapped therearound. From reel 14, cable C passes into base 10 through an opening 9 provided therefor, around a grooved idler roll 8 and into the groove of rotatable pulley 15 in the lower end of section 11. After rotatable pulley 15, cable C passes around rotatable pulley 16 at the top of section 11 and turns downwardly. Immediately in line with cable C as it leaves pulley 16 are pulleys 22 and 24 mounted in a horizontal plane normal to the horizontal plane of pulley 16. Cable C thus changes direction again, passes under and partially around pulleys 22 and 24, and extends upwardly from pulley 24 internally of walls 20' of sections 20 to rotatable pulley 26. Pulley 32, mounted for rotation in the bottom of section 30 is aligned with pulley 26 so as to permit cable C to pass around pulley 26, change direction and then pass around the underside of pulley 32. Cable C then passes upwardly through section 30, through eye bolt 36 and is secured therein by clamps 38.

Referring to FIGS. 1 and 2, a preferred light system for the instant tower will be described. A collar 39 is secured to the top of section 30 and has an upward extension 39' with a shoulder 39'' around the base thereof. Light support structure 40 is then rotatably received on collar 39 and supported thereby. Light support structure 40 comprises a sleeve 41 having a cross arm 43 secured thereto as by bolt 43'. Sleeve 41 telescopes around upward extension 39' of collar 39 and rests on shoulder 39''. A bolt 42 passes through sleeve 41 to engage extension 39' and secure support structure 40 against rotation therearound. Cross arm 43 is provided with a plurality of slots 45 along its length, each slot 45 being provided with an electrical power supply unit 47 having electrical cables 48 and connectors 49 therewith. Power supply units 47 all receive electrical power through electrical cable E that is connected to a power supply (not shown), and passes up through the various sections of the tower. Lights 50 are pivotally mounted on stands 52 at pivotal connection 53. Stands 52 are removably received in slots 45 and secured therein by bolts 54. Lights 50 are then electrically connected to power supply units 47 through association with connectors 49. According to the above described light arrangement, the lights may be rotated around the tower as a group by loosening bolt 42 and rotating support structure 40 to the desired position. Thereafter bolt 42 is retightened to secure the lights in the desired position. Further pivotal connections 53 between light stands 52 and lights 50 permit tilting of lights 50 to a desired angle to properly illuminate the desired article or area.

Figure 5:
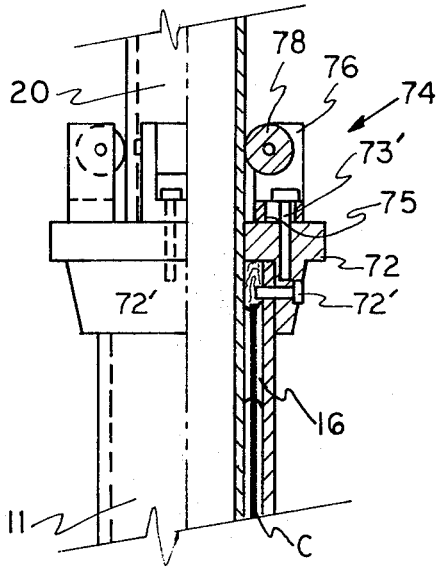
FIG. 5 is a side view of the guide means of the present invention having a cutaway portion to show a partial cross section thereof.
Figure 6:
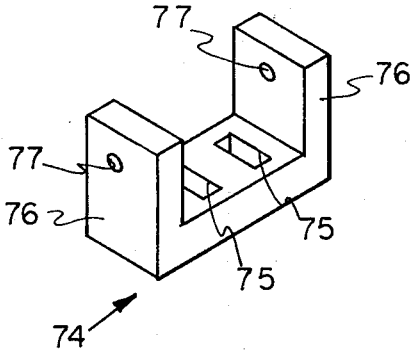
FIG. 6 is an isometric view of a preferred mount for the rotatable guides according to the teachings of the present invention.

A guide system 70, as mentioned earlier, is positioned adjacent the top of each section having a further extendible section nestable therein. Guide system 70 comprises a collar 72 that resides around the top of the section and is secured thereto by any suitable means so long as there is no interference with the cable drive system within the section or movement of the nestable section therethrough. Bolts 72' provide suitable securement means where the bolt 72' passes only to the inside wall of side 20' and does not extend into the interior of section 20. Collar 72 of guide means 70 is further provided with a roller mount 74 for each side of the tower section being guided thereby. As best seen in FIGS. 5 and 6, collar 72 has a plurality of openings 73 provided therein for receiving bolts 73' or the like for securing mount 74 thereto. Roller mount 74 is provided with longitudinal slots 75 through which bolts 73' pass into openings 73 of collar 72. Prior to tightening of bolts 73', mount 74 is slidable over collar 72 along the length of slots 75. Mount 74 has a pair of standards 76 extending upwardly therefrom and having openings 77 therein. A roller guide 78 is journaled for rotation in openings 77 of standards 76.

It is desirable for rollers 78 to engage the walls of each extendible section. Moreover, though tolerance can be maintained very closely in the manufacture of : sections, a combination of error in manufacture d expansion or contraction with the ambient temperıre dictates that the guide rollers be adjustable. :nce, with mount bolts 73′ loose, mount 74 can be ›ved laterally until roller 78 contacts the side of the :tion wall. Bolts 73′ are then tightened to maintain : adjustment. After each roller guide 78 has been so justed, the tower can be raised and lowered with ntinual proper alignment of the individual sections.

Figure 8:
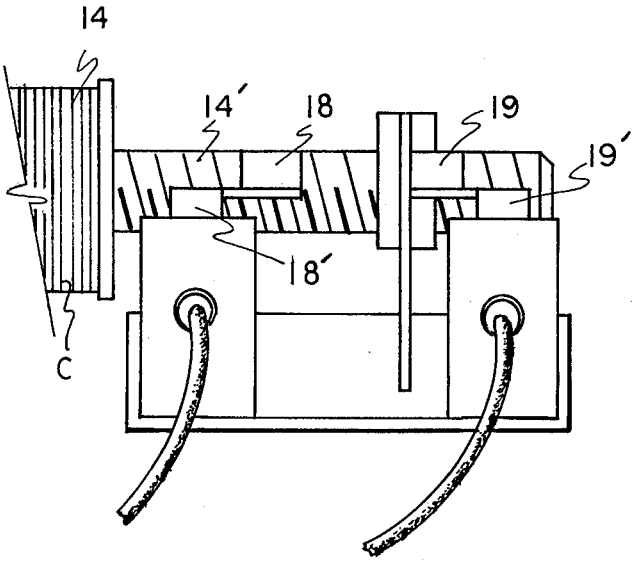
FIG. 8 is an enlarged side view of a portion of the single cable drive system according to the teachings of the present invention showing certain safety features thereon.

Safety features are likewise incorporated into the ver of the present invention. A tension measuring vice can be associated at some point with cable C to nstantly measure the tension on cable C. Such a vice is indicated as 7 in FIG. 2 whereby, should ten›n on cable C lessen beyond a predetermined ıount, all power to reel 14 is cut off whereby reel 14 nnot rotate to permit inadvertent lowering of the ver. Further, with reference to FIG. 8, additional ety features are included to prevent excess operation reel 14 during raising of the tower or lowering of the ver. A threaded member 14′ is associated with reel to move outwardly and inwardly with rotation of el 14. Threaded member 14′ has positioned along its ıgth electrical contact surfaces 18 and 19. Also mat: contact surfaces 18′ and 19′ are supported along : path of travel of threaded member 14′. Contact rfaces 18′ and 19′ are electrically associated with the :ctrical power supply and when contact is made beeen surface 18 on member 14′ and surface 18′ dur: upward movement of the tower, power is shut off to el 14. Hence, just beyond the end of upward move:nt of the sections, surface 18 engages surface 18′ to event further attempts to raise the sections which ›uld possibly cause the tower to buckle and fall. Conrsely, surface 19 is arranged to mate with surface 19′ ıt beyond the bottom of desired section collapse to event jamming of the nested sections, damage to the ide system or the like.

Figure 3:
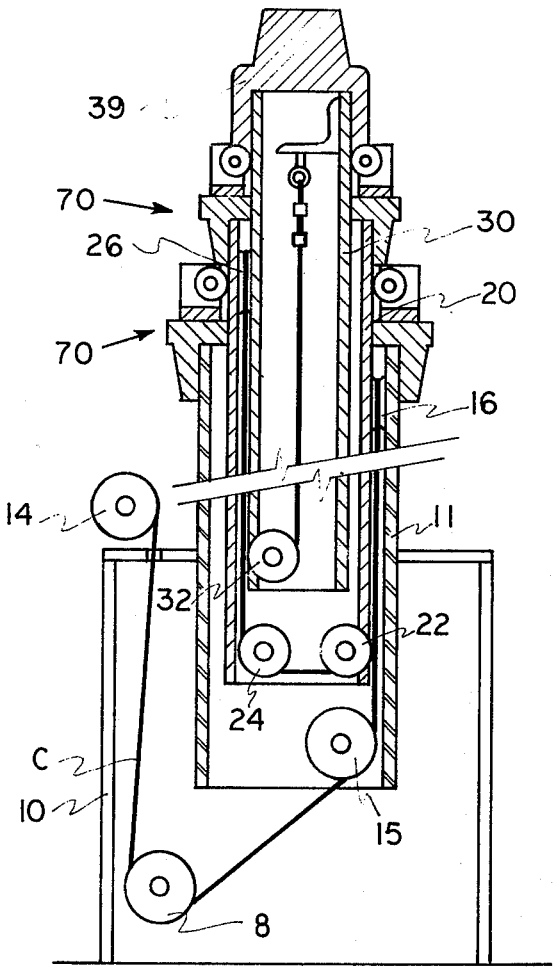
FIG. 3 is a vertical cross section of the tower of the present invention as shown in FIG. 2, but in the collapsed position.

FIG. 3 shows the tower in the collapsed position ıich would be readied for transport or maintenance. ction 20 is thus shown nested within stationary sec›n 11 and section 30 nested within section 20. Furer, light support structure 40 has been removed from › section 30, though it might be practical to remove ly the lights 50 and leave support structure 40 in ıce. With the tower in the collapsed condition, cable is extended to its maximum operative length.

Operatively speaking, the tower as shown collapsed FIG. 3 may be raised by starting reel 14 to rewind ble C onto reel 14. As cable C is wound around reel , the operative length of cable C decreases and sec›ns 20 and 30 are forced from within section 11. ıus, since the end of cable C is secured within section , the shortening of cable C overcomes the weight of : sections and the sections are lifted upwardly as ble C begins to wind onto reel 14. At the extent of ›ward movement of section 20, section 30 begins its ›ward ascent as cable C continues to be wound onto el 14. At the predetermined upward extent of move:nt of section 30, rotation of reel 14 is stopped and :tions 20 and 30 are supported in the raised position the strength of cable C.

Lowering of the tower is accomplished by rotation of el 14 in the opposite direction whereby the operative ıgth of cable C increases and section 30 moves into :tion 20 to compensate for the extra available cable. ıis procedure continues until sufficient cable has been played out to permit section 30 to nest within section 20 and section 20 to nest within section 11.

Safety features, as mentioned above, may be provided to prevent excess operation in either direction. Power cut-off switches are set just beyond desired limits of travel so that the tower will maintain power between normal operating limits.

Figure 4:
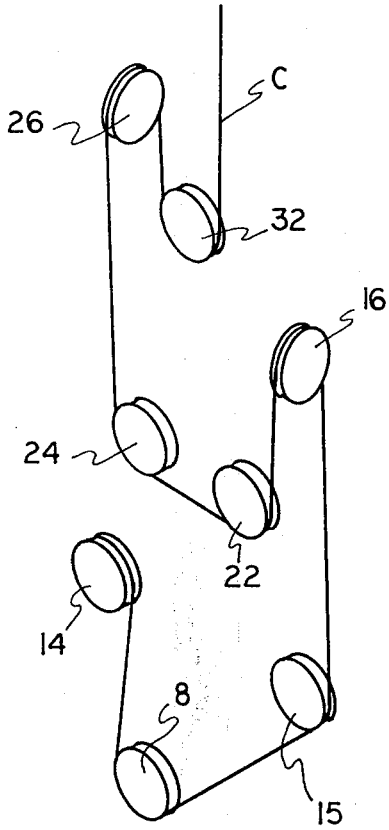
FIG. 4 is an isometric view of the single cable drive system according to the teachings of the present invention.

Referring to FIG. 4, the cable drive system is illustrated apart from the tower sections. Hence, rotation of reel 14 in a clockwise direction plays out cable C. The weight of the tower section supported by cable C and pulley 32 will then take up the extra cable being played out as it moves into the next adjacent lower section. Likewise, each succeeding section will collapse in a controlled manner into the next adjacent lower section until the tower has fully collapsed. The reverse is true for raising of the tower. As the cable is wound onto reel 14, the pulleys rotate and shortening of the operative length of cable C causes the respective sections to move upwardly. Rotation of the pulleys reduces the friction between cable C and the pulleys and hence improves the tower operation. Moreover, the rotatable pulleys are preferably manufactured from nylon or some similar low maintenance material whereby the drive system needs little if any lubrication.

Figure 7:
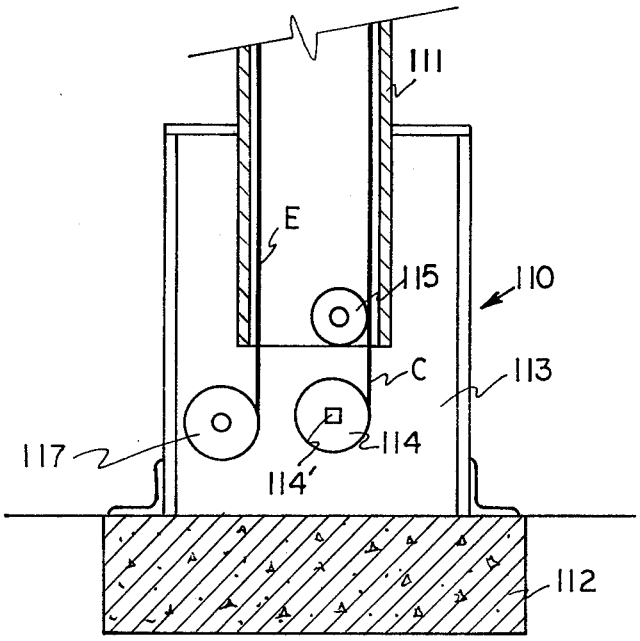
FIG. 7 is a vertical cross sectional view of a further embodiment of the present invention.

A further embodiment of the present invention is shown in FIG. 7. A tower such as shown in FIGS. 1 and 2 may be secured to a permanent base 110 which comprises a concrete or the like footing 112, a housing 113 and a stationary tower section 111. Operation of the modified tower would be the same as described hereinbefore. Instead or providing a power reel outside the base as shown in FIG. 1, however, a cable reel 114 is positioned within the base housing 113. Though motive power for reel 114 may be as desired, reel 114 is shown having a socket 114′ which may receive a mating lug from a hand crank, a hand carried power tool or the like (not shown). Further, a second reel 117 is mounted within housing 113 of base 110. Reel 117 has wrapped therearound a service line that is provided for the apparatus attached to the top tower section such as, for example, electrical lines, air hoses, water hoses or the like. Generally speaking, electrical lines E extend upwardly through the tower sections to electrical fixtures such as lights on the top of the tower. Reel 117 is spring loaded or otherwise equipped to maintain constant tension on the line at all positions of the tower.

The arrangement as shown in FIG. 7 is very suitable as a permanent light support structure for the parking lot at a shopping center, for example. In the event maintenance is required on the lights, or the tower, the light bulbs need to be replaced, or the like, the tower can readily be collapsed by a hand crank, a reversible hand carried power tool, or the like, to the desired level and the maintenance can be performed. The tower is then raised back to its extended position. Such a structure permits quick, easy and economical maintenance for the lighting fixtures. Likewise, the embodiment shown in FIG. 7 could be employed to light athletic fields, industrial areas, construction sites and the like.

Insofar as structural components of the present tower are concerned, virtually any multisided shape is suitable for the nestable, extendible sections. From an economic standpoint, however, it is preferred that the sections be extruded metal. Use of extruded metal eliminates the expense of fabrication of the section from individual structural components while retaining the necessary strength and rigidity. Moreover, an extruded square section is preferred though not necessary. Solid walls for the sections enclose the single cable drive system and thus present a much more pleasing appearance for the tower. Operation of the tower is further enhanced by the use of rotatable pulleys and guide rollers of materials that require little or no lubrication. Nylon rollers or pulleys on stainless steel axels are one example of such materials and are preferred.

Having described the present invention in detail, one skilled in the art may make variations and modifications thereto without departing from the scope of the invention. Accordingly, the scope of the present invention should be determined only by the claims appended hereto.

What is claimed is:

1. An extendible tower comprising:

a. a base section;

b. at least one intermediate section associated with said base section, each intermediate section being nestable within a next larger section, said base and said at least one intermediate section having rotatable pulleys received within the upper and lower ends thereof, all of said upper pulleys being mounted in a plane normal to the plane of said lower pulleys, c. a top section, said top section being nestable in the next adjacent intermediate section and having a rotatable pulley received in a lower end thereof and cable securing means received in an upper end thereof;

d. an individually adjustable external guide means for each side of each nestable section; and e. a single cable drive system, said system comprising a cable and drive means therefor, said cable being secured to said drive means, passing partially around said pulleys and an opposite end thereof being secured to said cable securing means within said top section, said cable passing substantially across the bottom of each intermediate section and being internally located all along said sections.

2. An extendible tower as defined in claim 1 wherein said adjustable guide means comprises a collar received around the upper end of said base and each intermediate section, each collar having a roller mount secured thereto adjacent each side of a section immediately adjacent thereto, each roller mount further having a roller guide rotatably received thereon, said mounts being laterally adjustable with respect to said sides of said sections to insure contact between said roller guide and the section side.

3. An extendible tower as defined in claim 2 wherein said sections are rectangular in shape, whereby each collar is provided with four roller mounts.

4. An extendible tower as defined in claim 2 wherein said drive system as cable tension means associated therewith, said tension means being operatively associated with said drive means.

5. An extendible tower as defined in claim 2 wherein said drive system has power cut off means associated therewith and operated by said drive system to prevent operation of said drive system beyond predetermined limits.

6. An extendible tower as defined in claim 2 wherein drive means comprise a cable reel and a power source for driving said reel.

7. An extendible tower as defined in claim 6 wherein said power source is an electric motor.

8. An extendible tower as defined in claim 6 wherein power source is a hand carried electric motor.

9. An extendible tower as defined in claim 2 wherein at least one light is secured to said top section.

10. An extendible tower as defined in claim 9 further comprising transport means, said base being secured to said transport means.

11. An extendible tower as defined in claim 10 wherein said transport means has power generating means received thereon.

* * * * *

UNITED STATES PATENT OFFICE

CERTIFICATE OF CORRECTION

Patent No. 3,952,467 Dated April 27, 1976

Inventor(s) Jackson A. Partlow

It is certified that error appears in the above-identified patent and that said Letters Patent are hereby corrected as shown below:

On the Title Page, Item 73, after "Assignee", please delete "Zip-Up Lighting Tower Company, Inc., Spartanburg, South Carolina" and insert therefor-- ZipUp, Inc., Rock Hill, S. C.--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*